US008753068B2

(12) United States Patent
Matsunaga et al.

(10) Patent No.: US 8,753,068 B2
(45) Date of Patent: Jun. 17, 2014

(54) PUMP AND HEAT PUMP APPARATUS

(75) Inventors: Noriaki Matsunaga, Tokyo (JP); Hiroki Aso, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 560 days.

(21) Appl. No.: 13/096,419

(22) Filed: Apr. 28, 2011

(65) Prior Publication Data

US 2011/0305562 A1 Dec. 15, 2011

(30) Foreign Application Priority Data

Jun. 14, 2010 (JP) ..... 2010-135156

(51) Int. Cl.
*F04D 29/041* (2006.01)

(52) U.S. Cl.
USPC ..... 415/104; 415/229; 416/186 R

(58) Field of Classification Search
USPC ..... 416/185, 186 R, 203, 224, 201 R; 415/104, 229; 417/420
See application file for complete search history.

(56) References Cited

U.S. PATENT DOCUMENTS

| | | | | |
|---|---|---|---|---|
| 4,013,384 | A | 3/1977 | Oikawa | |
| 5,154,587 | A * | 10/1992 | Mori et al. | 417/420 |
| 6,135,728 | A | 10/2000 | Klein et al. | |
| 6,439,845 | B1 * | 8/2002 | Veres | 415/206 |
| 6,443,710 | B1 * | 9/2002 | Tatsukami et al. | 417/365 |
| 6,722,863 | B2 * | 4/2004 | Maeda et al. | 417/420 |
| 2006/0245955 | A1 | 11/2006 | Horiuchi et al. | |
| 2009/0062020 | A1 | 3/2009 | Edwards et al. | |

FOREIGN PATENT DOCUMENTS

| | | | |
|---|---|---|---|
| EP | 2 031 251 | A2 | 3/2009 |
| FR | 2 278 957 | A1 | 2/1976 |
| JP | 07-217600 | A | 8/1995 |

(Continued)

OTHER PUBLICATIONS

Chinese Office Action (Notification of the First Office Action) dated May 30, 2013, issued in corresponding Chinese Patent Application No. 201110110141.5, and an English Translation of the Office Action ( 9 pgs.).

Extended European Search Report issued by the European Patent Office on May 3, 2013, in the corresponding European Patent Application No. 11003499.8 (7 pages).

(Continued)

*Primary Examiner* — Ninh H Nguyen
(74) *Attorney, Agent, or Firm* — Buchanan Ingersoll & Rooney PC

(57) ABSTRACT

A highly efficient and long-life pump is provided through improvement of pump efficiency by extending an effective length of a blade of an impeller and through reduction of friction loss of a thrust bearing. In a pump 110, a suction direction X and a discharge direction Y of a liquid are approximately perpendicular to each other. The pump 100 includes a shaft 27 positioned downstream of a suction inlet 22; an impeller 25 configured in a disk shape that rotates around the shaft 27, the impeller 25 having a plurality of blades 25*c* formed radially in a radial direction from a center area located at a center portion of the disk shape as seen in the suction direction X, the plurality of blades 25*c* being positioned at an approximately same longitudinal position as a longitudinal position of a discharge outlet 23; and a bearing (18-1) that receives the shaft 27, the bearing (18-1) being positioned at the center area of the impeller 25 and having a through hole (18-1*c*) as a guide portion for guiding the liquid drawn in from the suction inlet 22 to the discharge outlet 23.

16 Claims, 15 Drawing Sheets

(56) References Cited

FOREIGN PATENT DOCUMENTS

| | | | |
|---|---|---|---|
| JP | 2006-200427 | A | 8/2006 |
| JP | 2008-215738 | A | 9/2008 |
| JP | 2008-240655 | A | 10/2008 |
| JP | 2010-007642 | A | 1/2010 |
| TW | 200839104 | A | 10/2008 |
| WO | 2008/069124 | A1 | 6/2008 |

OTHER PUBLICATIONS

Office Action (Notice of Rejection) issued Sep. 10, 2013, by the Japanese Patent Office in corresponding Japanese Patent Application No. 2010-135156, and English Translation of the Office Action. (5 pages).

Chinese Office Action dated Jan. 13, 2014 issued in the corresponding Chinese Patent Application No. 201110110141.5 and English language translation (7 pages).

* cited by examiner

PUMP AND HEAT PUMP APPARATUS

TECHNICAL FIELD

This invention relates to a pump that conveys a liquid and to a heat pump apparatus including the pump.

BACKGROUND ART

FIG. 15 is a sectional view of a conventional pump (FIG. 2 of Patent Literature 1) used in a heat pump apparatus. This pump includes a stator part 17, a rotor part 21, a pump part 26, and a shaft 27. A lower end portion of the shaft 27 is fixed to a lower casing 15, and an upper end portion of the shaft 27 is fixed to a shaft support portion 35 of an upper casing 24, both in a non-rotatable manner. The rotor part 21 rotates freely around the shaft 27. The rotor part 21 includes a magnet part 20 at the outer circumference thereof, and a bearing 18 at the inner circumference, and the magnet part 20 and the bearing 18 are coupled together by a coupling member 19 made of a thermoplastic resin or the like. The coupling member 19 also forms a lower blade plate 25*b*. A plurality of blades 25*c*, arranged radially from the center in a circular arc or an involute curve, are placed between an upper blade plate 25*a* and the lower blade plate 25*b*, thereby forming an impeller 25. Rotation of the impeller 25 produces centrifugal force which acts on a liquid and causes the liquid to be pumped from a suction inlet 22 to a discharge outlet 23.

The shaft support portion 35 has the shape of a plurality of legs arranged in an inverted cone, and is configured to hold the positions of the shaft 27 and a thrust washer 28 which receives thrust force, and is fitted into a suction opening 36 of the upper blade plate 25*a*.

The stator part 17 includes an iron core 10 formed of a plurality of stacked electromagnetic steel sheets, a winding 11 wound through a slot (not shown) of the iron core 10 via an insulator 12 (an insulating material), a circuit board 13 connected with a lead wire 14, and the lower casing 15 which is approximately pot-shaped. The circuit board 13 is positioned near one side of the stator part 17 opposite from the pump part. The rotor part 21 is housed in a hollow portion of the approximately pot-shaped lower casing 15. A shaft hole 15*a* into which the shaft is fitted is formed at a center portion of the hollow portion of the lower casing 15.

CITATION LIST

Patent Literature

Patent Literature 1: JP 2008-215738 A

DISCLOSURE OF INVENTION

Technical Problem (Effective Length of Blades)

In the conventional pump used in the heat pump apparatus (Patent Literature 1), the shaft support portion 35 has the shape of a plurality of legs arranged in an inverted cone. The shaft support portion 35 is fitted into the suction opening 36 of the upper blade plate 25*a* in order to hold the positions of the shaft 27 and the thrust washer 28 which receives thrust force. That is, the center portion of the impeller 25 has an opening, namely the suction opening 36, which has approximately the same radius as the suction inlet 22. For this reason, the liquid pumping capacity of the pump is reduced by the capacity of this portion (the suction opening 36). This means that an effective length of the blades 25*c* is shortened by the length of the radius of the suction opening 36. This has been a problem, preventing the improvement of the efficiency of the pump.

(Thrust Force)

The suction opening 36 of the upper blade plate 25*a* has approximately the same radius as the radius of the suction inlet 22 (the suction opening 36 and the suction inlet 22 have approximately the same inside radius), so that the upper blade plate 25*a* has a smaller surface area than the lower blade plate 25*b*. This leads to a pressure difference between the upper and lower blade plates, generating thrust force. Consequently, this thrust force increases friction loss of the thrust bearing due to sliding movements and also increases wear of the thrust bearing, resulting in problems of low efficiency of the pump and short longevity of the pump.

(Backflow)

Because there is a gap between the upper blade plate 25*a* and the upper casing 24, there has been a problem that some of the liquid pumped outwardly by the impeller 25 is not directed to the discharge outlet 23, but is flown back to the suction inlet 22, thereby reducing the efficiency of the pump.

This invention aims to provide a highly efficient and long-life pump and heat pump apparatus by extending the effective length of the blades toward the inside radius of the suction inlet, reducing the friction loss of the thrust bearing, and preventing the backflow of the liquid to the suction inlet.

Solution to Problem

A pump according to this invention is a pump that includes a suction inlet for drawing in a liquid and a discharge outlet for discharging the liquid drawn in, wherein a suction direction and a discharge direction of the liquid are approximately perpendicular to each other, and the pump includes:

a shaft positioned downstream of the suction inlet such that a longitudinal direction of the shaft is approximately same as the suction direction;

an impeller configured in a disk shape that rotates around an axis of rotation located in the shaft, the impeller having a plurality of blades formed radially in a radial direction from a center area located at a center portion of the disk shape as seen in the suction direction, the plurality of blades being positioned at a longitudinal position approximately same as a longitudinal position of the discharge outlet when a longitudinal direction is defined in terms of the longitudinal direction of the shaft, and the impeller being configured to rotate around the axis of rotation located in the shaft, thereby causing the liquid to be drawn in from the suction inlet and discharged from the discharge outlet; and a bearing that receives the shaft, the bearing having a guide portion positioned at the center area of the impeller and configured to guide the liquid drawn in from the suction inlet to the discharge outlet.

Advantageous Effects of Invention

This invention can provide a pump wherein an effective length of a blade is practically extended toward the inside radius of a suction inlet.

DESCRIPTION OF EMBODIMENTS

First Embodiment

Referring to FIGS. 1 to 8, a pump 110 of a first embodiment will be described.

Figure 1:
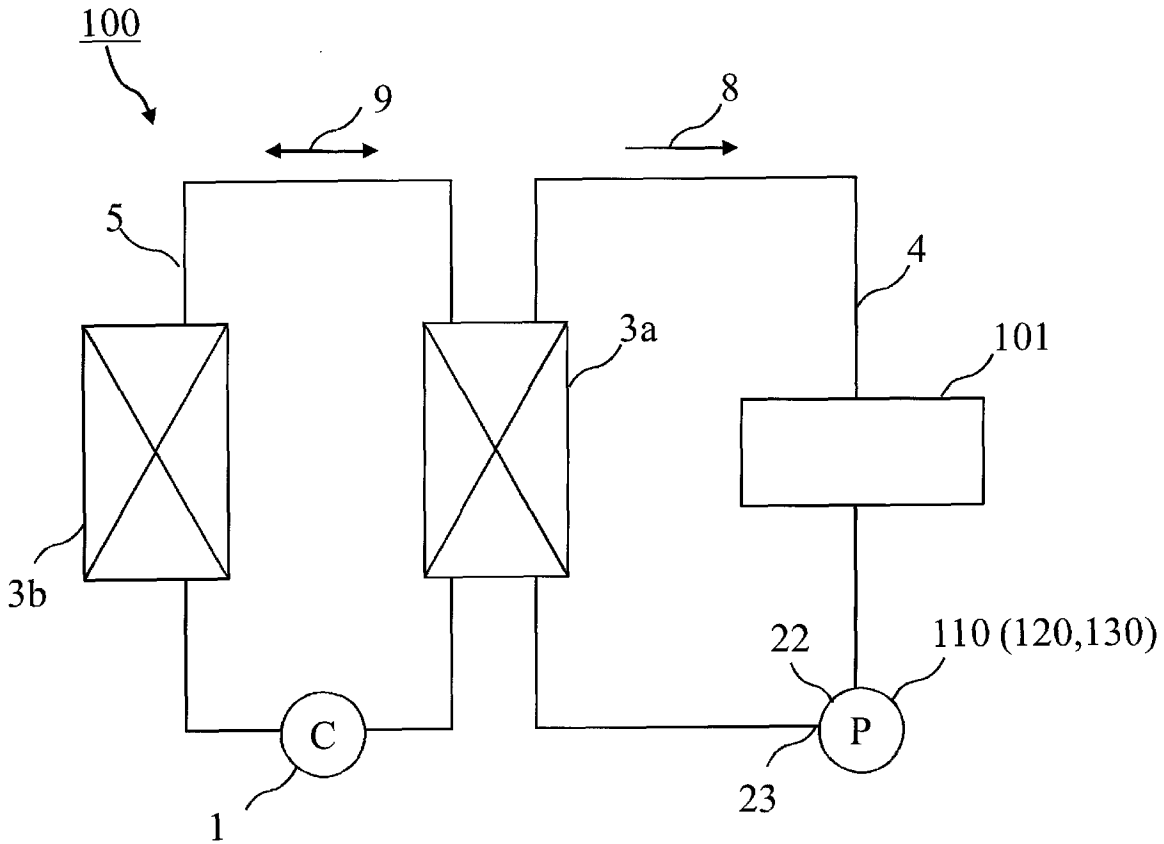
FIG. 1 is a view of a usage model of a pump 110 according to a first embodiment.

FIG. 1 is a view showing a usage model of the pump 110 of the first embodiment. As shown in FIG. 1, the pump 110 is used, for example, in a heat pump apparatus.

Figure 2:
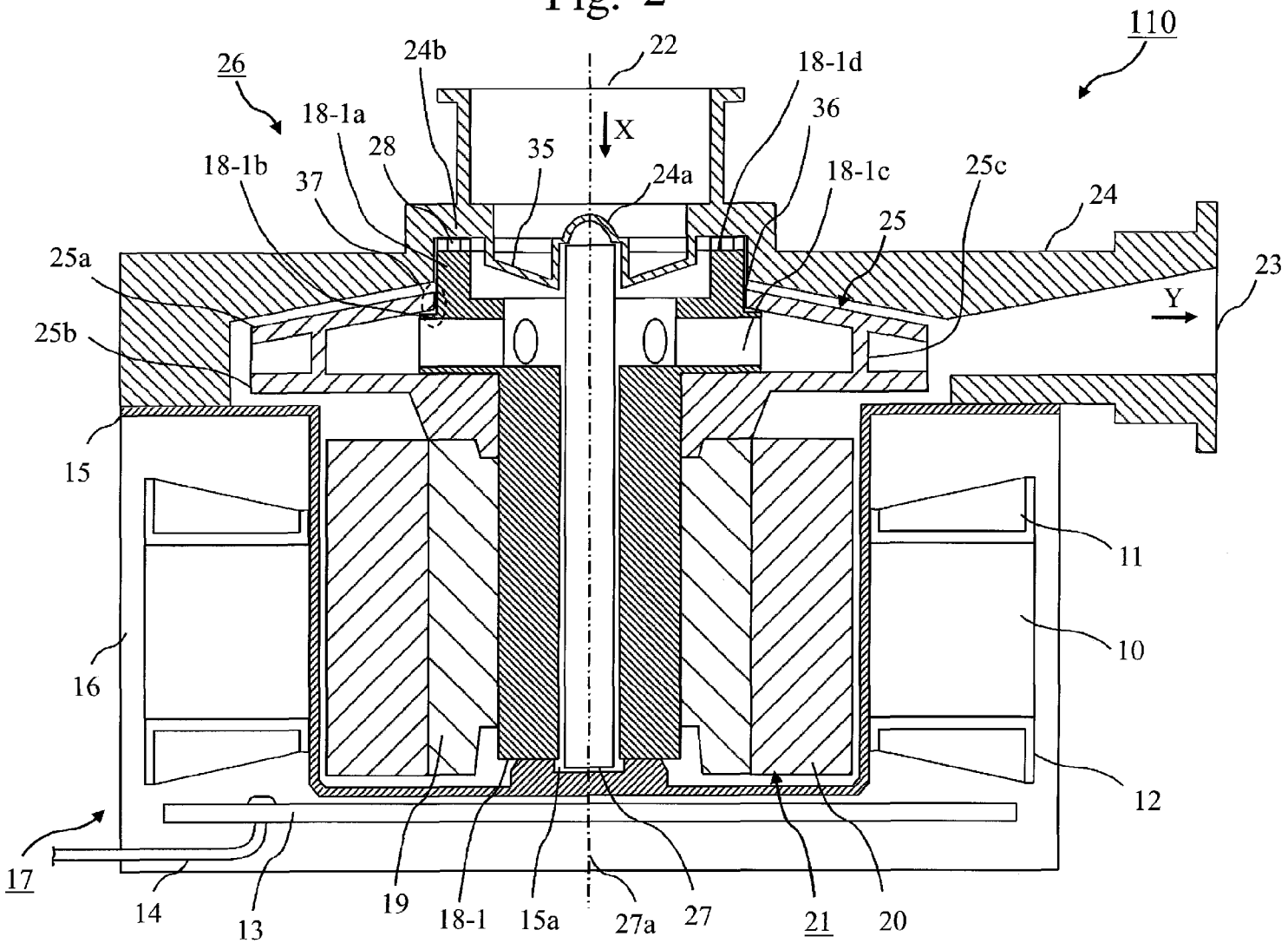
FIG. 2 is a sectional view of the pump 110 according to the first embodiment.

FIG. 2 is a sectional view (a longitudinal sectional view) of the pump 110.

Figure 3:
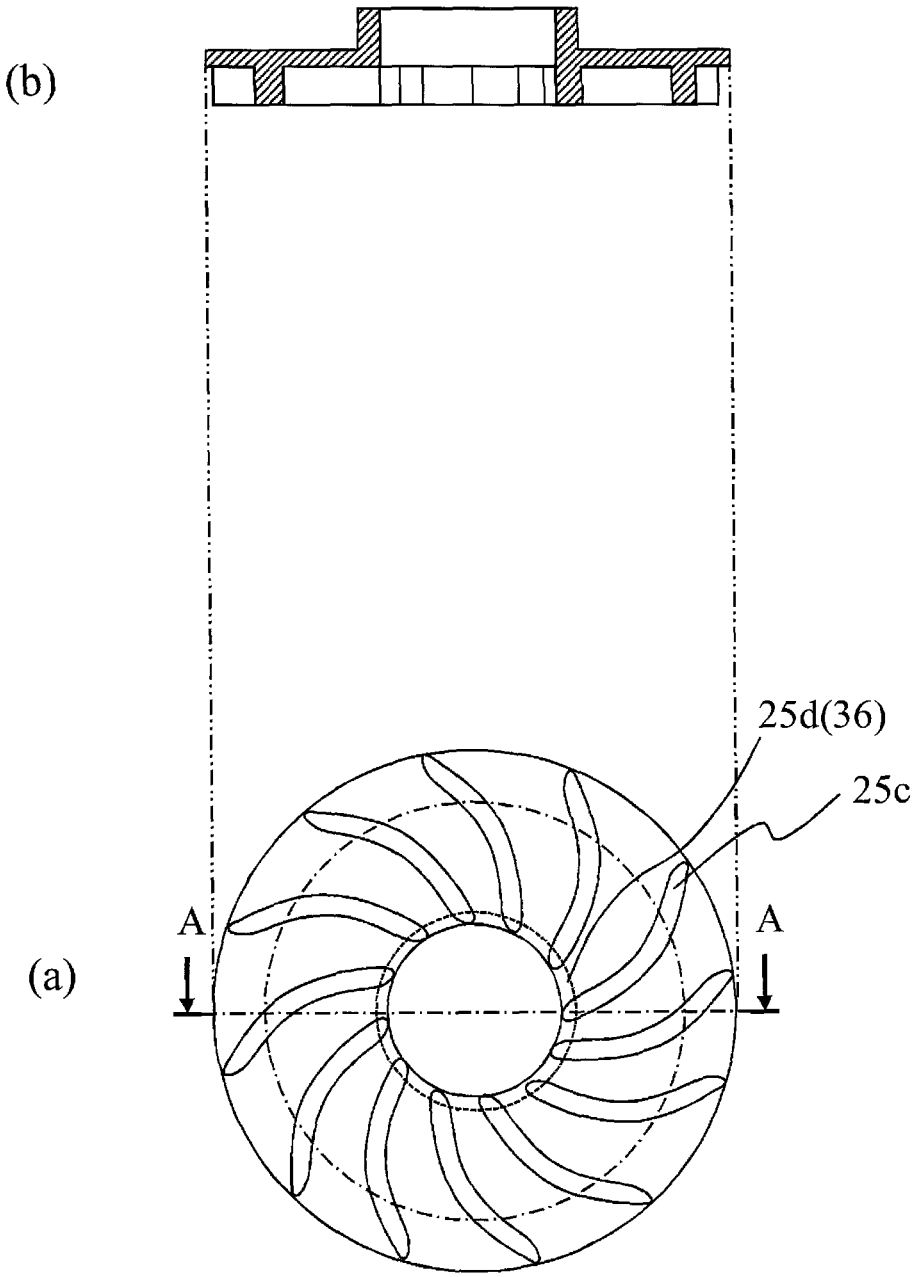
FIG. 3 is a view for describing an impeller 25 according to the first embodiment.

FIG. 3 is a view for describing an impeller 25. In FIG. 3, (a) is a schematic view of blades 25*c* of the impeller 25 as seen in the X direction (a suction direction of a liquid) of FIG. 2. In FIG. 3, (b) shows the section A-A of (a) of FIG. 3.

Figure 4:
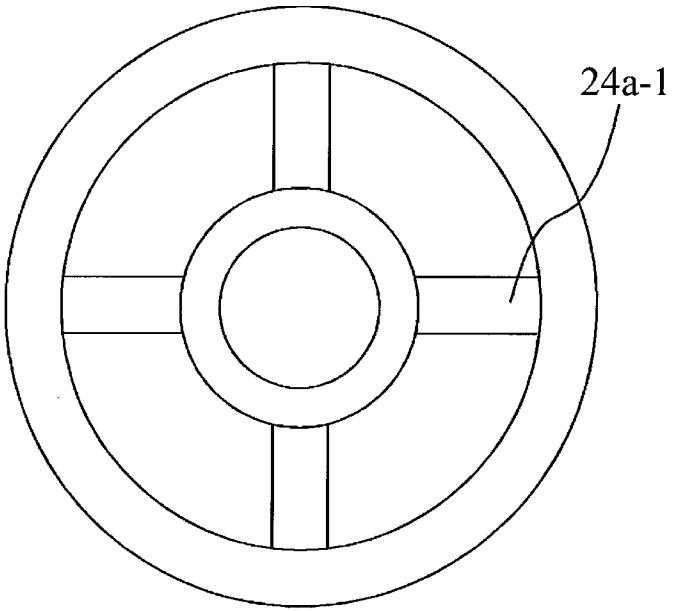
FIG. 4 is a perspective view of a suction inlet 22 according to the first embodiment, as seen in the X direction.

FIG. 4 is a view showing a configuration example of a shaft hole 24*a* of an upper casing as seen in the X direction of FIG. 2. In FIG. 4, the shaft hole 24*a* of the upper casing has a shape with four legs (24*a*-1), but this is an example. The shaft hole 24*a* may be configured in any shape that allows the shaft 27 to be fitted therein and that does not offer great resistance to the liquid to be drawn in.

Figure 5:
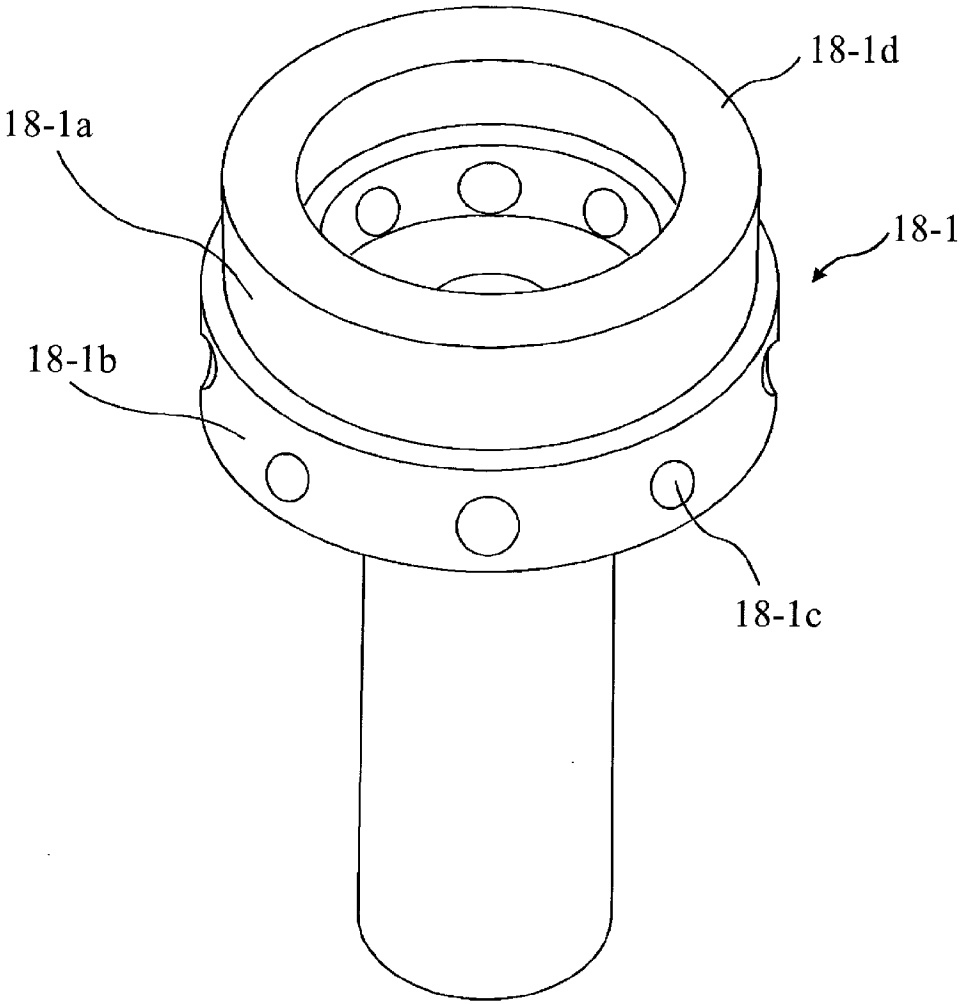
FIG. 5 is a perspective view of a bearing (18-1) according to the first embodiment.

FIG. 5 is a perspective view of a bearing (18-1) of the pump 110.

Figure 6:
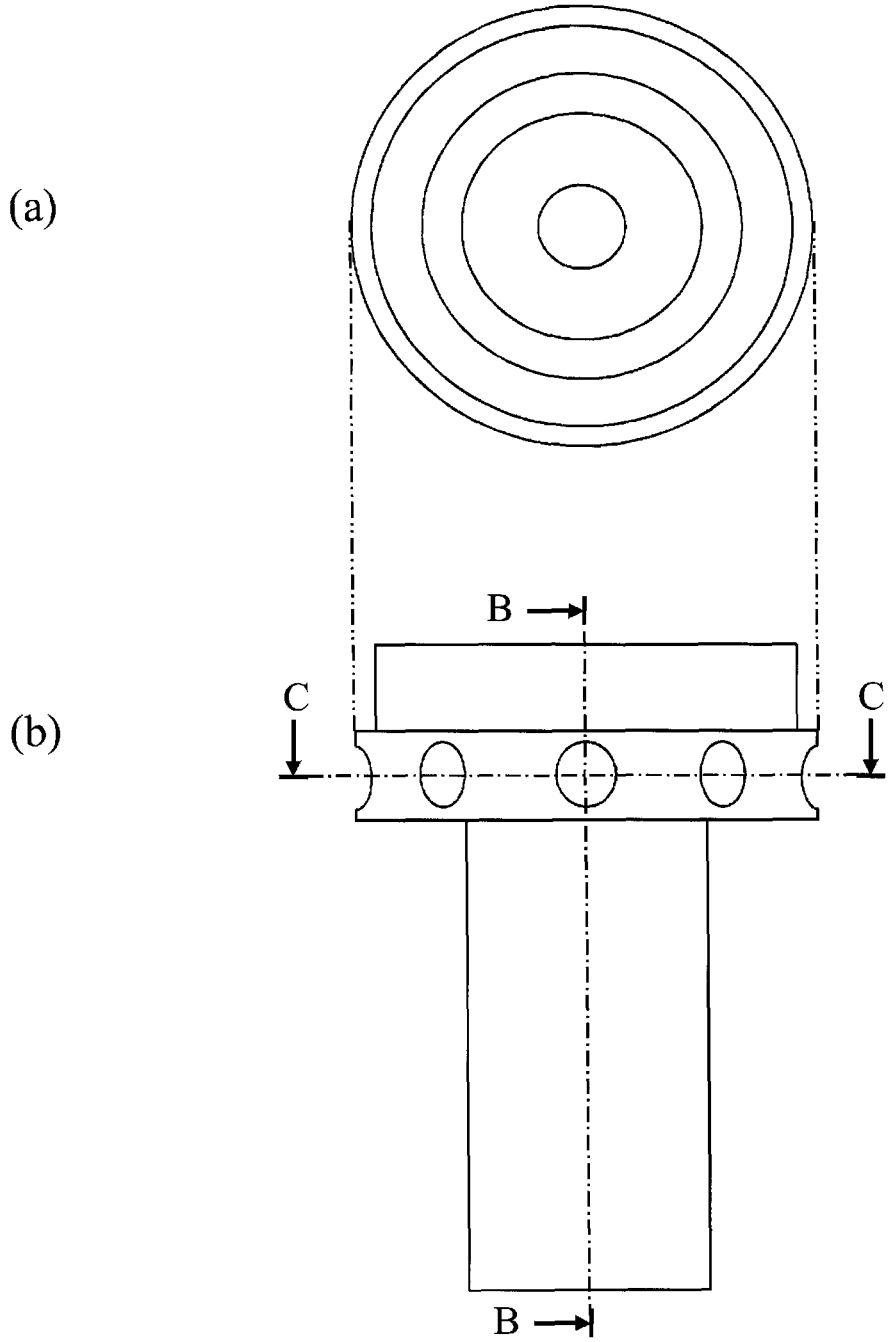
FIG. 6 shows a plan view and a front view of the bearing (18-1) according to the first embodiment.

FIG. 6 shows a plan view (as seen in the X direction) and a front view of the bearing (18-1).

Figure 7:
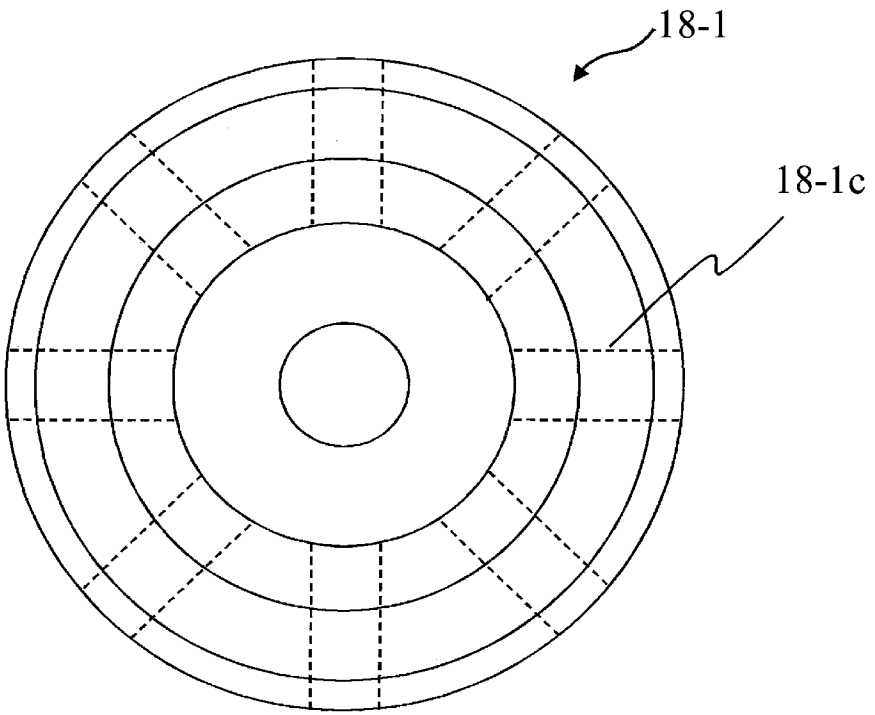
FIG. 7 is a plan view of the bearing (18-1) according to the first embodiment.

FIG. 7 is a view showing the plan view of FIG. 6 ((a) of FIG. 6) with through holes (18-1*c*) indicated by dashed lines.

Figure 8:
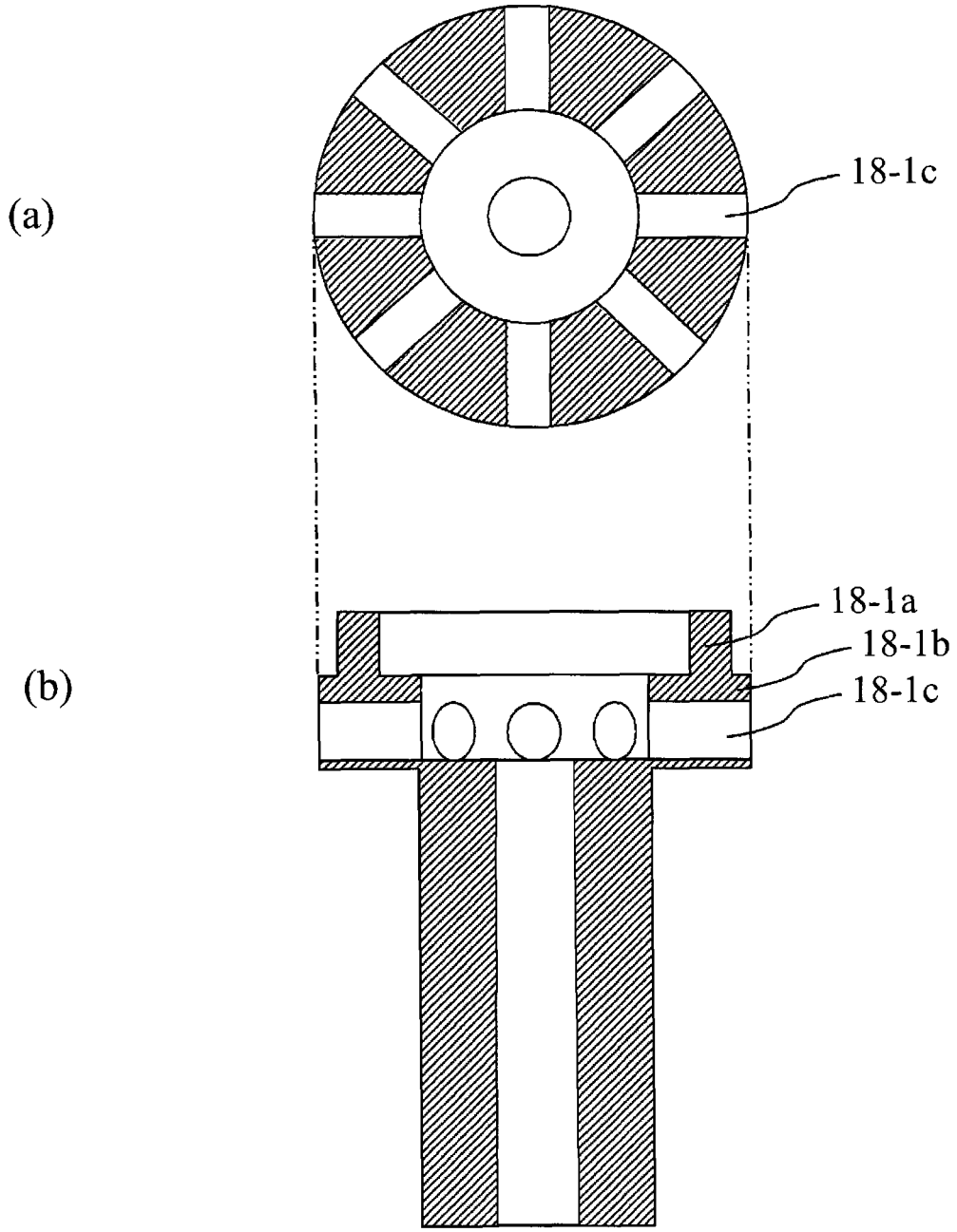
FIG. 8 shows sectional views of the bearing (18-1) of the first embodiment, taken on the line B-B and the line C-C.

FIG. 8 shows the section B-B and the section C-C of (b) of FIG. 6.

(Heat Pump Apparatus 100)

As shown in FIG. 1, the heat pump apparatus 100 is configured with a compressor 1 that compresses a refrigerant, heat exchangers 3*a* and 3*b*, and so on. The heat pump apparatus 100 includes a refrigerant circuit 5 through which a refrigerant 9 flows. For example, the heat exchanger 3*a* is a radiator, and the heat exchanger 3*a*, a heat utilization device 101 that utilizes hot water heated by the heat exchanger 3*a*, and the pump 110 are connected with pipes, thereby forming a liquid circuit 4 through which a liquid 8 flows. Examples of the heat utilization device 101 include a tank for storing a liquid and an external heating element such as a floor heating panel.

(Configuration of the Pump 110)

The pump 110 is configured such that the bearing (18-1) rotates with a rotor part 21.

Referring to FIG. 2, a configuration of the pump 110 will be described. The pump 110 includes a stator part 17, the rotor part 21, a pump part 26, and the shaft 27. The shaft 27 is fixed (non-rotatable). The rotor part 21 rotates around the shaft 27.

(Stator Part 17)

(1) A configuration of the stator part 17 will be described. The stator part 17 includes an iron core 10 which is approximately doughnut-shaped and formed of a plurality of stacked electromagnetic steel sheets stamped into a predetermined shape, a winding 11 wound through a slot (not shown) of the iron core 10 via an insulator 12 (an insulating material), a circuit board 13 connected with a lead wire 14, and a lower casing 15 which is approximately pot-shaped. The circuit board 13 is positioned near one axial end portion of the stator part 17 (at an opposite side from the pump part 26).

(2) The stator part 17, configured with the iron core 10 around which the winding 11 is wound and the circuit board 13, is formed integrally with a molding resin 16. The exterior of the stator part 17 is formed by the molding resin 16.

(3) The stator part 17 and the rotor part 21 constitute, for example, a brushless DC motor.

(Rotor Part 21)

The rotor part 21 is configured with the bearing (18-1), a coupling member 19, and a magnet part 20. The bearing (18-1) is positioned at a center portion of the rotor part 21. The coupling member 19 made of resin is positioned around the bearing (18-1). The magnet part 20 coupled with the bearing (18-1) by the coupling member 19 is positioned around the coupling member 19.

(Pump Part 26)

The pump part 26 includes an upper casing 24 having a suction inlet 22 and a discharge outlet 23 and the impeller 25. The liquid circuit 4 is connected with the suction inlet 22 and the discharge outlet 23.

The rotor part 21 is housed in a hollow portion of the approximately pot-shaped lower casing 15. A shaft hole 15*a* into which the shaft 27 is fitted is formed at a center portion of the hollow portion of the lower casing 15. The shaft 27 is inserted into the shaft hole 15*a* in a non-rotatable manner. To achieve this, the shaft 27 to be inserted into the shaft hole 15*a* has a notched portion in its circular shape.

The bearing (18-1) of the rotor part 21 is inserted over the shaft 27 fixed to the lower casing 15. A thrust washer 28 is further placed on the bearing (18-1) such that an end face (18-1*d*) of the bearing (18-1) comes into contact with the thrust washer 28, thereby forming a thrust bearing. Then, the end portion of the shaft 27 facing the pump part 26, which protrudes from the thrust washer 28, is inserted into the shaft hole 24*a* of the upper casing, so as to form the pump part 26 enclosed in the upper and lower casings. The rotor part 21 to which the impeller 25 is fixed is placed around the shaft 27 in a freely rotatable manner.

A space enclosed by the lower casing 15 and the upper casing 24 is filled with the liquid of the liquid circuit 4. Thus, the rotor part 21, the impeller 25, the shaft 27, and the thrust washer 28 come into contact with the liquid flowing through the pump 110. The pump 110 is a canned pump in which the liquid flowing through the pump 110 comes into contact with the rotor part 21 of the brushless DC motor.

The bearing (18-1) is configured to pass through a center portion (a center area 25*d*) of the impeller 25 and protrude from an upper blade plate 25*a* toward the suction inlet 22.

The bearing (18-1) is formed such that the outer radius of this protruding portion, namely a cylinder portion (18-1*a*), is equivalent to or slightly larger than the inside radius of the suction inlet 22 and larger than a shaft support portion. The thrust washer 28 is placed in slidable contact with the upper end face (18-1*d*) of the cylinder portion (18-1*a*), thereby forming the thrust bearing. The thrust washer 28 is made to contact the end face (18-1*d*) of the bearing (18-1) so as to be non-rotatable in the rotational direction relative to the upper casing 24. By configuring the thrust bearing in this way, backflow of the liquid to the suction inlet 22 is prevented. Further, a flow path (a guide portion) is provided in the bearing (18-1) in order to make the liquid flow from the suction inlet 22 through the impeller 25 to the discharge outlet 23 in a direction approximately perpendicular to the shaft. This flow path is formed, for example, by a plurality of the through holes (18-1*c*) placed at a longitudinal position corresponding to a longitudinal position of the impeller 25.

By making a side wall of the cylinder portion (18-1*a*) of the bearing (18-1) to be in slidable contact with an edge of a suction opening 36 of the upper blade plate 25*a* (a region 37 of FIG. 2 indicated by a dashed circle), the through holes (18-1*c*) provided in the bearing (18-1) form flow paths continuing from flow paths of the impeller 25. This makes it possible to extend an effective length of the blades 25*c* toward the inside radius of the suction inlet 22.

It is also possible to reduce a pressure difference between the upper blade plate 25*a* and the lower blade plate 25*b*, so that thrust force applied to the thrust bearing can be reduced and friction loss can be reduced. Conventionally, a shaft support portion 35 of the upper casing 24 is fitted into the hollow portion of the center portion of the impeller 25, thereby making the effective length of the blades 25*c* shorter. In contrast, the bearing (18-1) that rotates with the rotor part 21 has the through holes (18-1*c*) acting as the flow paths directed approximately perpendicularly to the shaft. These flow paths thus function in practically the same manner as the blades 25*c*, thereby providing the same effect as extending the blades 25*c* toward the inside radius (a shrouding effect).

Referring to the drawings, the configuration of the pump 110 will be described in further detail. As shown in FIG. 2, the pump 110 includes the suction inlet 22 through which the liquid is drawn in and the discharge outlet 23 through which the liquid drawn in is discharged. In the pump 110, a suction direction X and a discharge direction Y of the liquid are approximately perpendicular to each other. The pump 110 includes the shaft 27, the impeller 25, and the bearing (18-1). The shaft 27 is positioned downstream of the suction inlet 22 such that a longitudinal direction of the shaft 27 is approximately the same as the suction direction X. The impeller 25 has the shape of a disk that rotates around the shaft 27. That is, as shown in FIG. 2, the impeller 25 rotates around an axis of rotation 27*a* located in the shaft 27. As shown in (a) of FIG. 3, the impeller 25 includes a plurality of the blades 25*c* formed radially in a radial direction from the center area 25*d* located at a center portion of the disk shape as seen in the suction direction X.

As shown in FIG. 2, the impeller 25 is positioned such that the longitudinal position of the plurality of the blades 25*c* is approximately the same as the longitudinal position of the discharge outlet 23, the longitudinal direction being defined in terms of the longitudinal direction of the shaft 27. In the pump 110, the rotor part 21 coupled with the impeller 25 rotates around the shaft 27, thereby causing the liquid to be drawn in through the suction inlet 22 and discharged through the discharge outlet 23. The bearing (18-1) receives the shaft 27. The bearing (18-1) has the guide portion (flow paths) positioned in the center area 25*d* of the impeller 25. In the bearing (18-1), the guide portion is the through holes (18-1*c*). The through holes (18-1*c*) guide the liquid drawn in through the suction inlet 22 to the discharge outlet 23. There are, for example, eight of the through holes (18-1*c*) as shown in FIGS. 5, 7, 8, and so on. However, any number of the through holes (18-1*c*) may be formed. The flow paths may have any sectional shape, and the area thereof may be larger at the outside radius than at the inside radius.

(Sealing Capability)

As shown in FIG. 2, the impeller 25 is configured with the upper blade plate 25*a*, a lower blade plate 25*b*, and the plurality of the blades 25*c*. The upper blade plate 25*a* forms an upper side of the disk-shaped impeller 25. The suction opening 36 ((a) of FIG. 3) is formed at the center portion of the upper blade plate 25*a*, the suction opening 36 being a circular opening through which the liquid drawn in through the suction inlet 22 is drawn in. The lower blade plate 25*b* forms a lower side of the disk shape, and is positioned to face the upper blade plate 25*a*. The plurality of the blades 25*c* may be formed between the upper blade plate 25*a* and the lower blade plate 25*b*. Alternatively, the blades 25*c* may be formed integrally with the upper blade plate 25*a* or the lower blade plate 25*b*.

As shown in FIG. 5, the bearing (18-1) includes the cylinder portion (18-1*a*) which is hollow and a thick cylinder portion (18-1*b*) (an example of the guide portion) which is hollow, thick-walled, and formed continuously with (under) the cylinder portion (18-1*a*). As shown in FIG. 2, the cylinder portion (18-1*a*) fits into the suction opening 36 of the upper blade plate 25*a*, and the side wall of the cylinder portion (18-1*a*) is in close contact with the edge of the suction opening 36 (the region 37 in FIG. 2). As a means to achieve close contact, welding or the like may be used, for example. The thick cylinder portion (18-1*b*) has a thick wall thicker than a wall of the cylinder portion (18-1*a*). The plurality of the through holes (18-1*c*) are formed in this thick wall so as to be directed approximately perpendicularly to the shaft 27.

In the pump 110, the side wall of the cylinder portion (18-1*a*) is in slidable contact with the edge of the suction opening 36 (the region 37 in FIG. 2), so that backflow can be prevented.

(Thrust Bearing)

As shown in FIG. 2, the pump 110 includes the upper casing 24 in which the suction inlet 22 is formed, and the thrust washer 28 supported by the upper casing 24 so as to be non-rotatable relative to the shaft 27. The bearing (18-1) constitutes the thrust bearing by the upper end face (18-1*d*) of the cylinder portion (18-1*a*), the thrust washer 28, and a support portion 24*b* of the upper casing supporting the thrust washer 28.

The bearing (18-1) of the first embodiment is a single-component bearing that functions both in radial and thrust directions, and thus also has the effect of being more dimensionally accurate compared to when the radial and thrust directions are supported by separate bearings.

(Materials)

(1) With regard to materials used in the first embodiment, the upper casing 24, for example, is composed of a hot water-resistant and chemical-resistant thermoplastic resin, such as denatured polyphenylene ether (hereinafter m-PPE), polyphenylene sulfide (hereinafter PPS), or syndiotactic polystyrene (hereinafter SPS).

(2) The coupling member 19 and the impeller 25 (the upper blade plate 25*a*, the lower blade plate 25*b*, and the blades 25*c*) are also composed of a resin such as m-PPE, PPS, or SPS.

(3) For the lower casing 15, a metal such as aluminum, stainless steel, or copper may also be used in place of a resin such as m-PPE, PPS, or SPS.

(4) The shaft 27 is composed of stainless steel, ceramic, or the like.

(5) The magnet part 20 is composed of a plastic magnet part made of one type or a mixture of a plurality of types of magnetic particles selected from the group consisting of ferrite particles, neodymium particles, samarium-iron-nitrogen particles, and so on, mixed with a binder resin such as polyamide or PPS.

(6) The bearing (18-1) is composed of a highly slidable and wear-resistant thermoplastic resin such as PPS containing carbon fiber or fluororesin, or alternatively sintered carbon, ceramic, or the like.

(7) The coupling member 19 (including the lower blade plate 25*b*) may be formed integrally with the bearing (18-1) from the same material. In that case, the material is preferably a highly formable and slidable resin, namely PPS containing carbon fiber or fluororesin.

(8) The thrust washer 28 is composed of ceramic or stainless steel, and may also be composed of PPS containing carbon fiber or fluororesin.

(9) It is preferable to use a different material, instead of the same material, for each component of the bearing to be in slidable contact with another component of the bearing, thereby precluding the possibility of scoring.

The configuration of the pump 110 of the first embodiment described above reduces the friction loss of the thrust bearing, extends the effective length of the blades toward the inside radius of the suction inlet 22, and prevents the backflow of the liquid to the suction inlet 22, thereby making it possible to provide a highly efficient and long-life pump and heat pump apparatus.

Second Embodiment

A second embodiment differs from the first embodiment in the configuration of the bearing. A bearing (18-2) of the second embodiment is configured such that flow paths are formed by a plurality of blades (18*c*-2) in contrast to the plurality of the through holes of the bearing (18-1) of the first embodiment. Other than this, the second embodiment is the same as the first embodiment. Thus, as with the first embodiment, the bearing (18-2) rotates with the rotor part 21.

Figure 9:
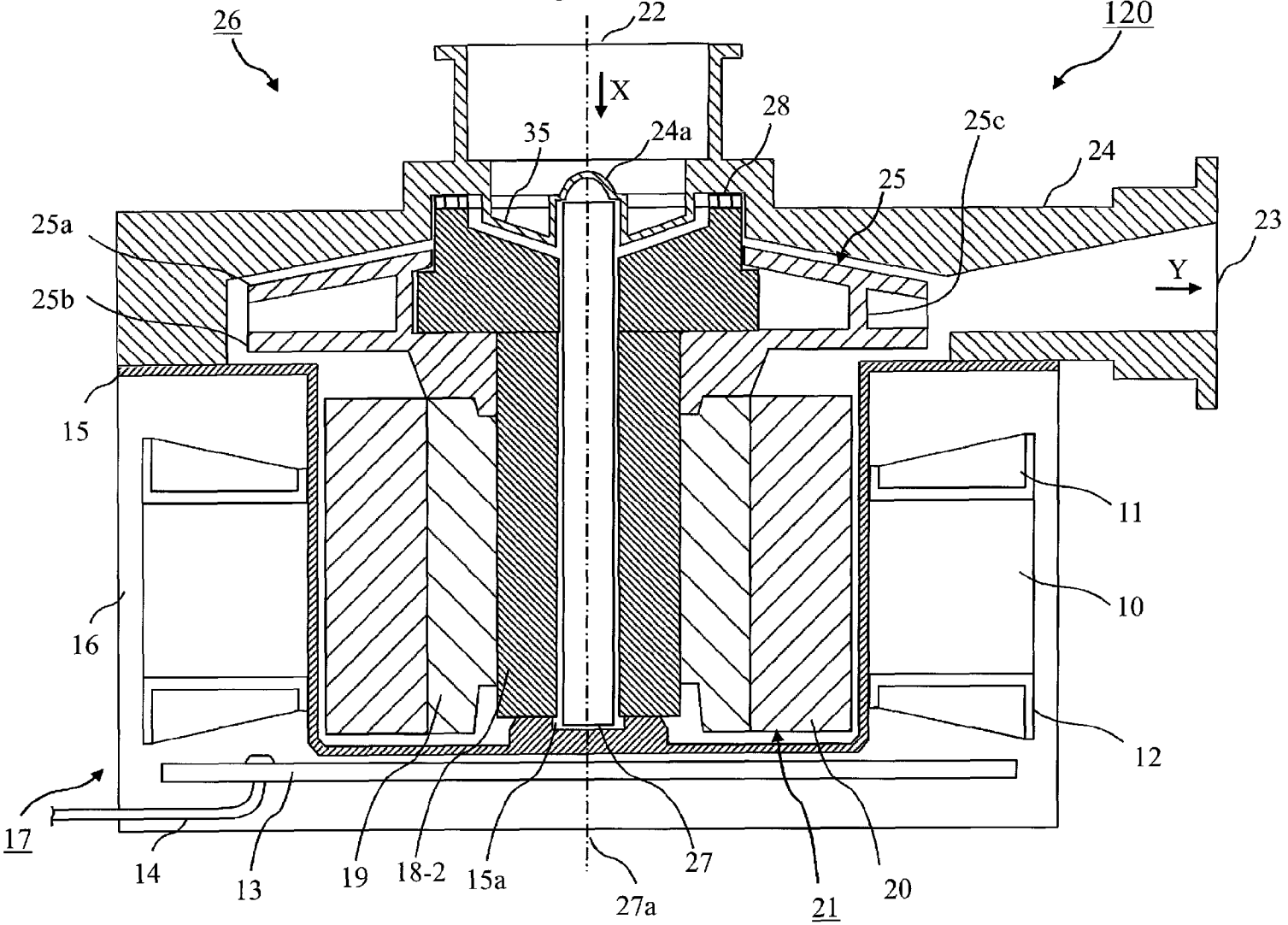
FIG. 9 is a sectional view of a pump 120 according to a second embodiment.
Figure 10:
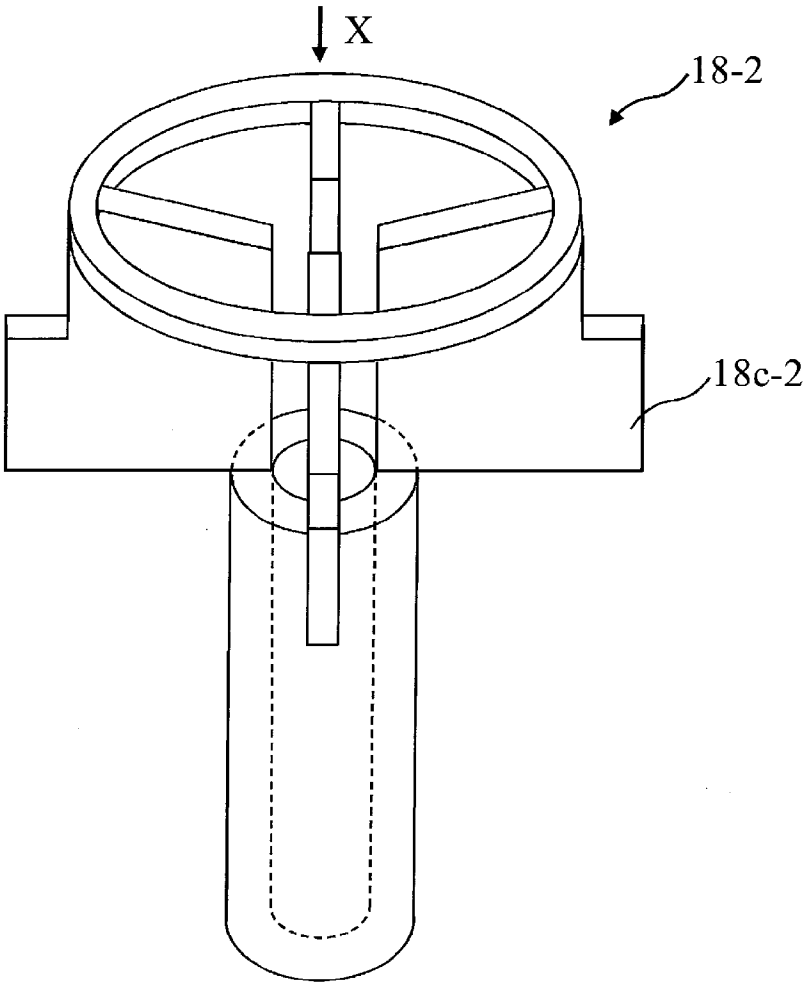
FIG. 10 is a perspective view of a bearing (18-2) according to the second embodiment.

Referring to FIGS. 9 and 10, a pump 120 of the second embodiment will be described.

FIG. 9 is a sectional view of the pump 120 of the second embodiment.

FIG. 10 is a perspective view of the bearing (18-2). The bearing (18-2) includes the plurality of the blades (18*c*-2) as the guide portion for guiding the liquid drawn in through the suction inlet 22 to the discharge outlet 23.

Figure 11:
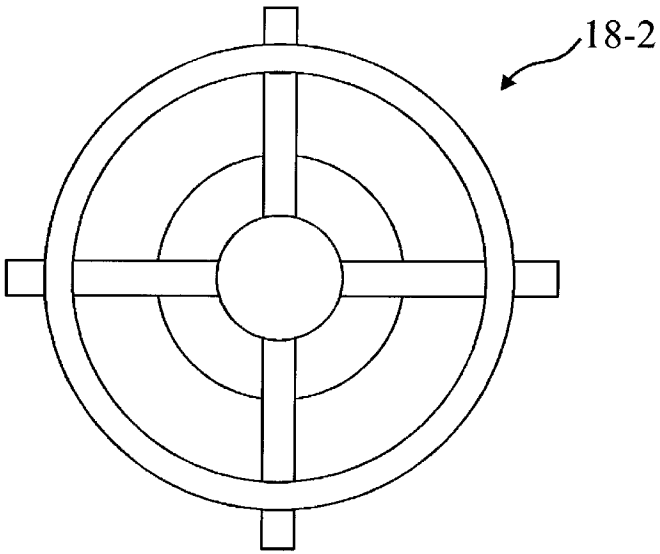
FIG. 11 is a plan view of the bearing (18-2) according to the second embodiment.

FIG. 11 is a plan view of the bearing (18-2) (as seen in the X direction).

As shown in FIG. 10, the bearing (18-2) includes the plurality of the blades (18*c*-2) forming flow paths for passing the liquid from the suction inlet 22 through the impeller 25 to the discharge outlet 23 in a direction approximately perpendicular to the shaft. This has an equivalent effect as the bearing (18-1) of the first embodiment. In this case, the blades (18*c*-2) may be formed to correspond with the blades 25*c* of the impeller 25. That is, when the blades 25*c* are formed in a circular arc or an involute curve, the blades (18*c*-2) may be formed based on the same pattern rule (formed to have the same radius of curvature or involute curve). The number of the blades (18*c*-2) provided in the bearing (18-2) may be the same as or larger or smaller than the number of the blades 25*c* of the impeller 25. In other respects, the configuration is the same as that of the first embodiment.

Third Embodiment

A pump 130 of a third embodiment will be described. The pump 130 of the third embodiment will be described wherein the bearing (18-2) of the second embodiment is divided into an upper part and a lower part. In the pump 130, the shaft 27 and an upper bearing (18-3*a*) rotate with the rotor part 21. The impeller 25 is fixed to the rotor part 21. Thus, as shown in FIG. 12, the impeller 25 rotates around the axis of rotation 27*a* located in the shaft 27.

Figure 12:
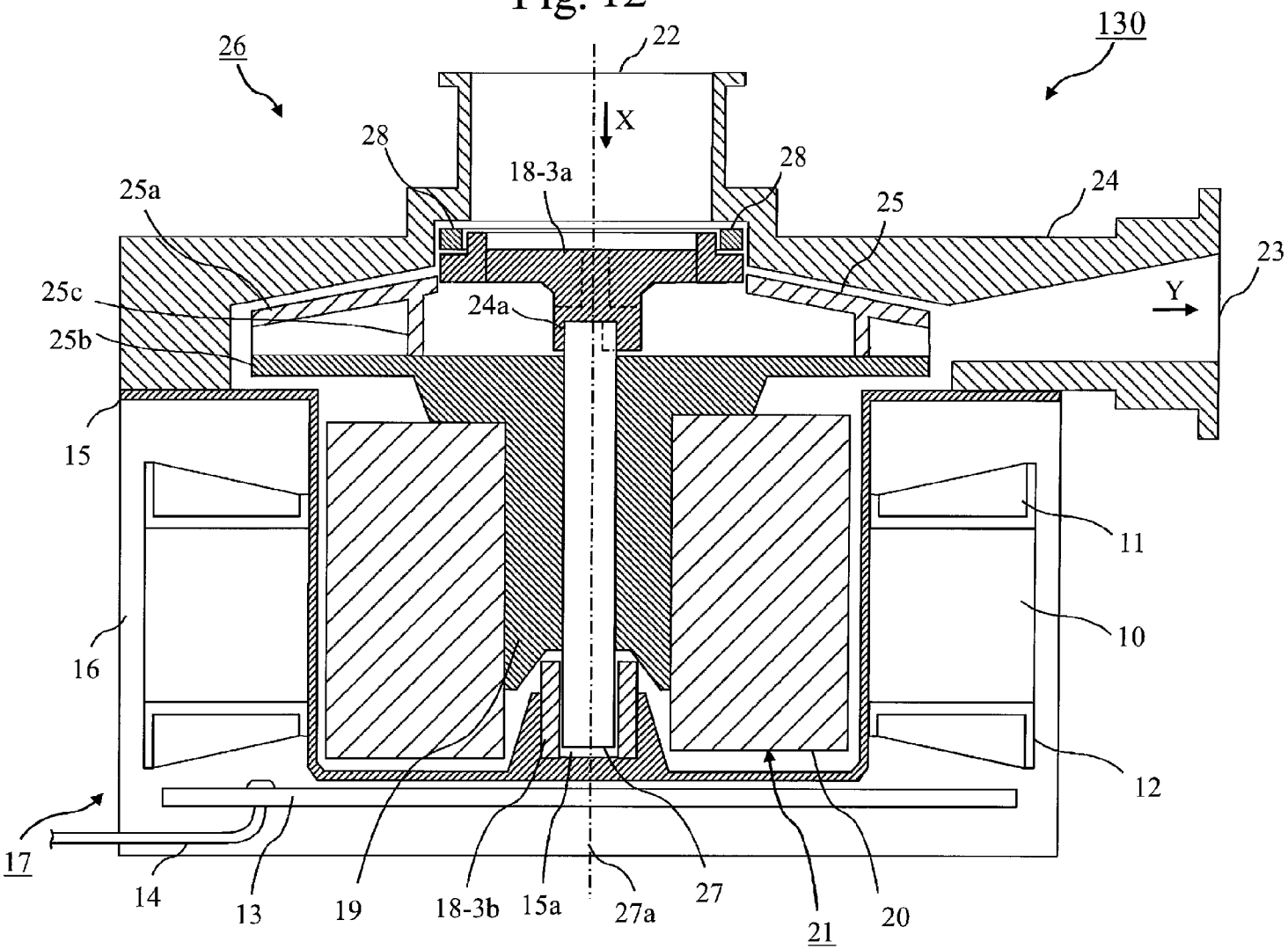
FIG. 12 is a sectional view of a pump 130 according to a third embodiment.
Figure 13:
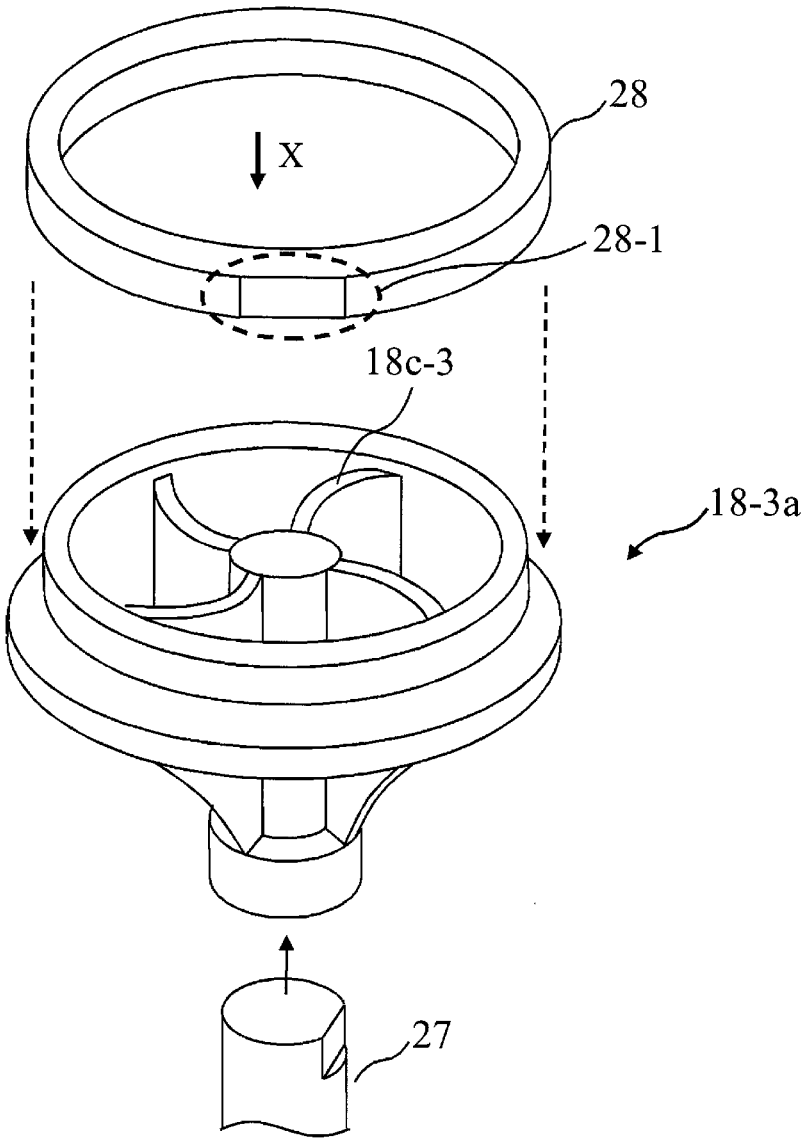
FIG. 13 is a perspective view of an upper bearing (18-3*a*) according to the third embodiment.
Figure 14:
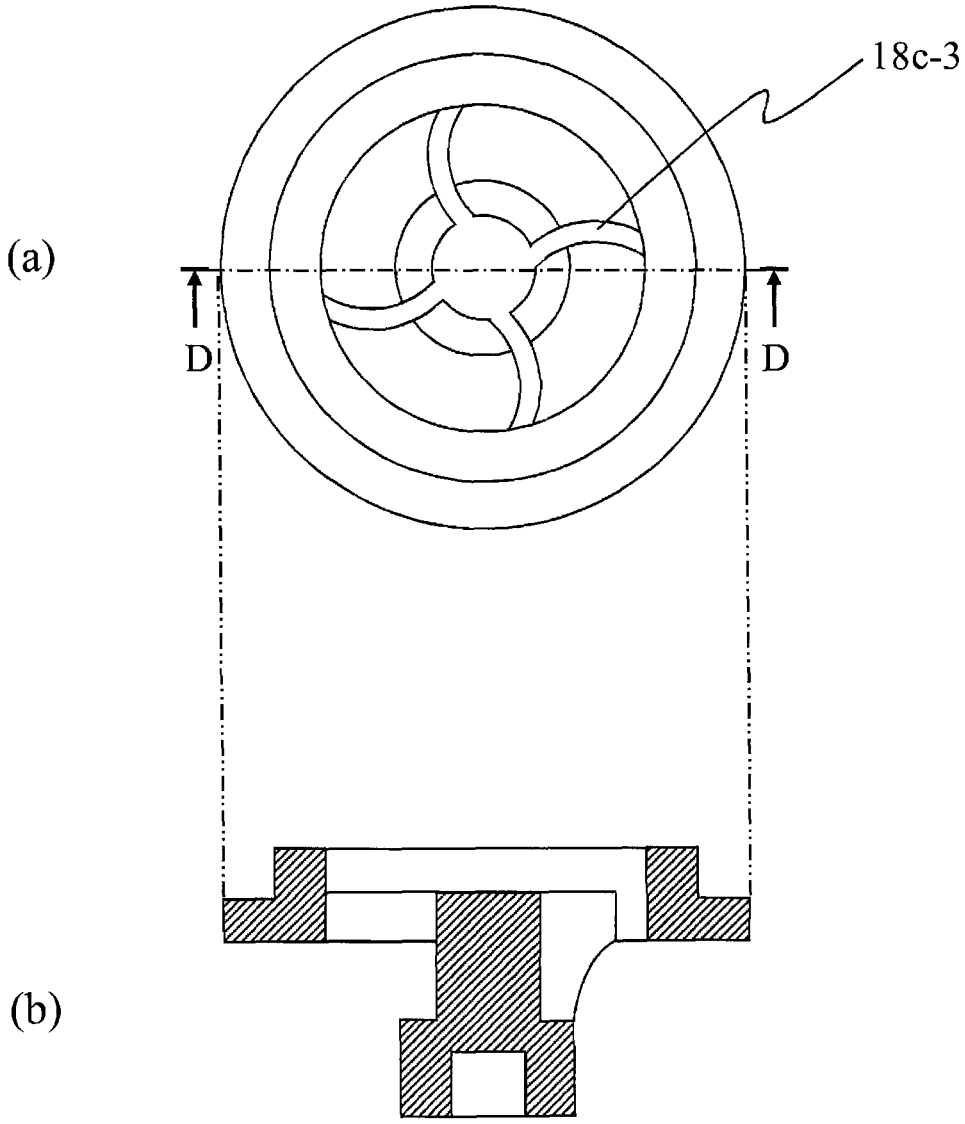
FIG. 14 shows a plan view and a sectional view of the upper bearing (18-3*a*) according to the third embodiment.
Figure 15:
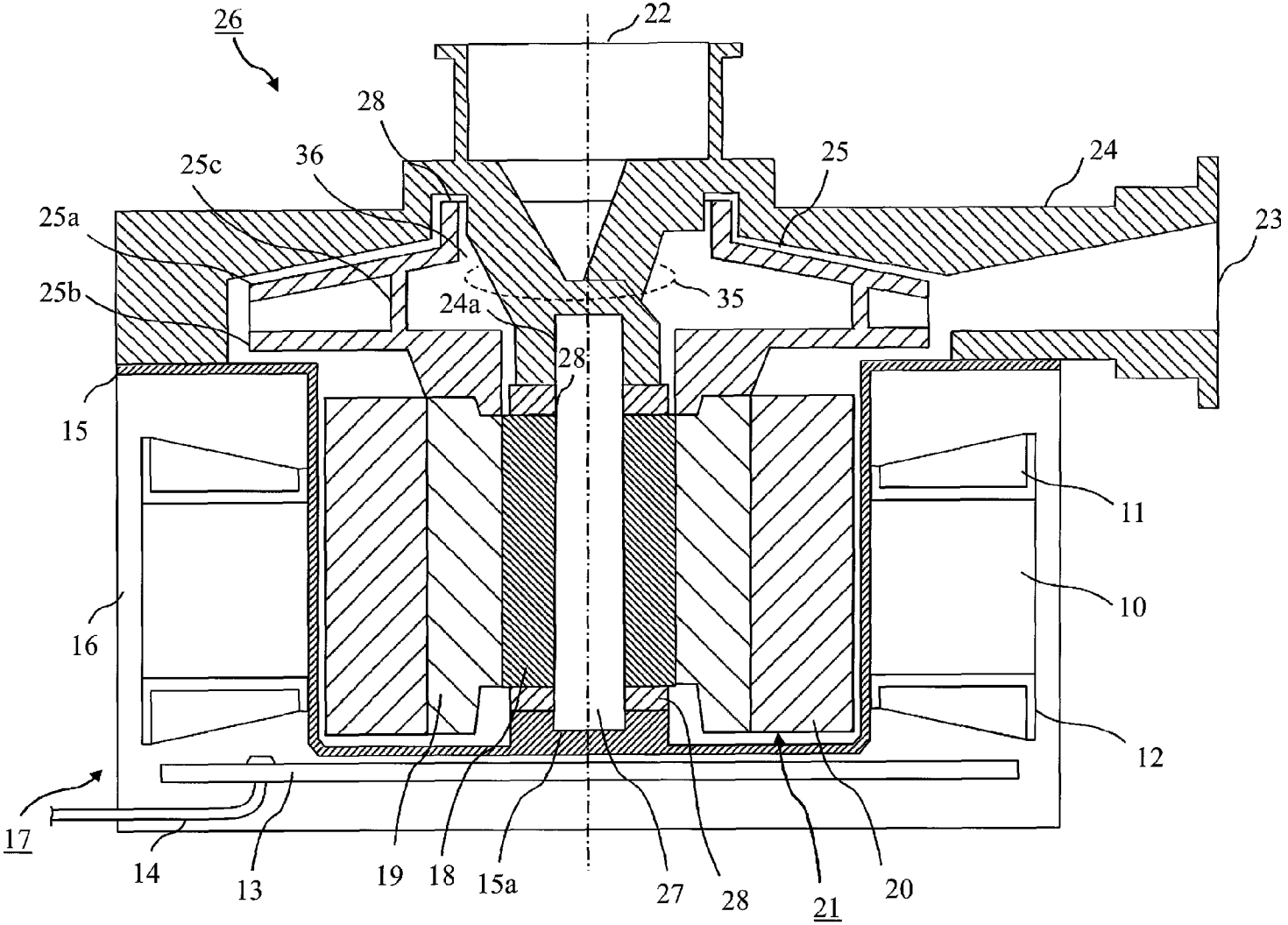
FIG. 15 is a view showing conventional art.

Referring to FIGS. 12 to 14, the pump 130 of the third embodiment will be described. FIG. 12 is a sectional view of the pump 130 of the third embodiment. As shown in FIG. 12, in the pump 130, the bearing is divided into two parts, namely the upper bearing (18-3*a*) and a lower bearing (18-3*b*). The upper bearing (18-3*a*) receives one end portion of the shaft 27 at a side facing the suction inlet 22, and includes a plurality of blades (18*c*-3) (FIG. 13) as the guide portion. The lower bearing (18-3*b*) receives the other end portion of the shaft 27 at the opposite side from the suction inlet 22.

FIG. 13 is a perspective view of the upper bearing (18-3*a*). The upper bearing (18-3*a*) has the plurality of the blades (18*c*-3) as the guide portion.

FIG. 14 shows a front view (as seen in the X direction of FIG. 1) and a sectional view taken on the line D-D.

(Rotor Part 21)

As shown in FIG. 12, the magnet part 20 and the shaft 27 are coupled by the coupling member 19. The coupling member 19 also serves as the lower blade plate 25*b*. These (the magnet part 20, the shaft 27, and the coupling member 19) are fixedly coupled as one unit in both rotational and axial directions. The blades 25*c* and the upper blade plate 25*a* are fixedly coupled to the lower blade plate 25*b* by welding or the like, so as to form one unit. In this way, the magnet part 20, the coupling member 19, the shaft 27, the upper bearing (18-3*a*), and so on constitute the rotor.

As shown in FIG. 12, the lower bearing (18-3*b*) is fitted into the shaft hole 15*a* of the lower casing 15 so as to be non-rotatable in the rotational direction. A lower end portion of the shaft 27 coupled with the rotor part 21 is inserted into the lower bearing (18-3*b*) in a freely rotatable manner. The upper bearing (18-3*a*) is inserted over an upper end portion of the shaft 27 so as to be non-rotatable in the rotational direction relative to the shaft 27. That is, the upper bearing (18-3*a*) and the rotor part 21 rotate in unison.

(Upper Bearing (18-3*a*))

As shown in FIGS. 13 and 14, an upper portion of the upper bearing (18-3*a*) is shaped like an inverted triangular pyramid, and is in slidable contact, in both thrust and radial directions, with the thrust washer 28 outside (under) the radius of the suction inlet 22. FIG. 13 shows how the thrust washer 28 is attached to the upper bearing (18-3*a*). The thrust washer 28 is attached to the suction inlet 22 of the upper casing 24 so as to be non-rotatable in the rotational direction. The thrust washer 28 may be made non-rotatable in the rotational direction, for example as shown in FIG. 13, by cutting away a portion of the circumference thereof to form a notched portion 28-1 and also forming an opposing portion of the upper casing 24 in the same shape (forming a portion opposing the notched portion 28-1 as a protrusion having the same shape). As shown in FIG.

13, the upper portion of the upper bearing (18-3*a*) includes the blades (18*c*-3), having a cross-sectional shape (the same as the shape of the blades (18*c*-3) shown in (a) of FIG. 14) closely resembling (a shape approximately the same as) the shape of the blades 25*c* of the impeller 25. The number of the blades and the phase thereof are also made to closely resemble (to be approximately the same as) those of the blades 25*c*, thereby forming flow paths by the blades (18*c*-3) (the guide portion). In other respects, the configuration is the same as that of the first embodiment.

The configuration of the third embodiment can also produce the same effect as the first embodiment.

The pumps 110 to 130 described in the first to third embodiments have been shown, by way of example, as pumps used for conveying and circulating the liquid in the heat pump apparatus 100, but may also be adaptable to a household pump and so on.

REFERENCE SINGS LIST

1: compressor, 3*a*, 3*b*: heat exchangers, 4: liquid circuit, 5: refrigerant circuit, 8: liquid, 9: refrigerant, 10: iron core, 11: winding, 12: insulator (insulating material), 13: circuit board, 14: lead wire, 15: lower casing, 15*a*: shaft hole of the lower casing, 16: molding resin, 17: stator part, 18-1, 18-2: bearings, 18-3*a*: upper bearing, 18-3*b*: lower bearing, 18-1*a*: cylinder portion, 18-1*b*: thick cylinder portion, 18-1*c*: through hole, 18-1*d*: end face, 18*c*-2, 18*c*-3: blades, 19: coupling member, 20: magnet part, 21: rotor part, 22: suction inlet, 23: discharge outlet, 24: upper casing, 24*a*: shaft hole, 24*a*-1: leg, 24*b*: support portion, 25: impeller, 25*d*: center area, 26: pump part, 27: shaft, 27*a*: axis of rotation, 28: thrust washer, 30: flow path, 35: shaft support portion, 36: suction opening, 37: region, 100: heat pump apparatus, 110, 120, 130: pumps

The invention claimed is:

1. A pump including a suction inlet for drawing in a liquid and a discharge outlet for discharging the liquid drawn in, wherein a suction direction and a discharge direction of the liquid are approximately perpendicular to each other, the pump comprising:

a shaft positioned downstream of the suction inlet such that a longitudinal direction of the shaft is approximately same as the suction direction;

an impeller configured in a disk shape that rotates around an axis of rotation located in the shaft, the impeller having a plurality of blades formed radially in a radial direction from a center area located at a center portion of the disk shape as seen in the suction direction, the plurality of blades being positioned at a longitudinal position approximately same as a longitudinal position of the discharge outlet when a longitudinal direction is defined in terms of the longitudinal direction of the shaft, and the impeller being configured to rotate around the axis of rotation located in the shaft, thereby causing the liquid to be drawn in from the suction inlet and discharged from the discharge outlet; and a bearing that receives the shaft, the bearing having a guide portion positioned at the center area of the impeller and configured to rotate with the impeller, thereby forming flow paths connected with flow paths of the impeller.

2. A heat pump apparatus including the pump of claim 1.

3. The pump of claim 1, wherein a part of the bearing having the guide portion has a larger outer diameter than the remaining part of the bearing.

4. The pump of claim 1, wherein the bearing is T-shaped in cross-section.

5. The pump of claim 1, wherein the guide portion comprises a plurality of through holes extending through a wall of the bearing.

6. The pump of claim 1, wherein a part of the bearing having the guide portion has an inside diameter that is substantially equal to an inside diameter of the suction inlet.

7. The pump of claim 1, wherein an uppermost part of the bearing that is closest to the suction inlet has an inside diameter that is substantially equal to an inside diameter of the suction inlet.

8. The pump of claim 1, wherein the guide portion is aligned in the discharge direction such that the discharge outlet and the guide portion are at the same distance in the suction direction from the suction inlet.

9. A pump including a suction inlet for drawing in a liquid and a discharge outlet for discharging the liquid drawn in, wherein a suction direction and a discharge direction of the liquid are approximately perpendicular to each other, the pump comprising:

a shaft positioned downstream of the suction inlet such that a longitudinal direction of the shaft is approximately same as the suction direction;

an impeller configured in a disk shape that rotates around an axis of rotation located in the shaft, the impeller having a plurality of blades formed radially in a radial direction from a center area located at a center portion of the disk shape as seen in the suction direction, the plurality of blades being positioned at a longitudinal position approximately same as a longitudinal position of the discharge outlet when a longitudinal direction is defined in terms of the longitudinal direction of the shaft, and the impeller being configured to rotate around the axis of rotation located in the shaft, thereby causing the liquid to be drawn in from the suction inlet and discharged from the discharge outlet; and a bearing that receives the shaft, the bearing having a guide portion positioned at the center area of the impeller and configured to guide the liquid drawn in from the suction inlet to the discharge outlet, wherein the impeller includes an upper blade plate forming an upper side of the disk shape and having, at a center portion thereof, a suction opening, the suction opening being a circular opening through which the liquid drawn in from the suction inlet is drawn in, and a lower blade plate forming a lower side of the disk shape and positioned to face the upper blade plate;

the plurality of blades are formed between the upper blade plate and the lower blade plate; and the bearing rotates with the impeller and includes a cylinder portion being hollow and configured to fit into the suction opening of the upper blade plate and have a side wall in close contact with an edge of the suction opening.

10. The pump of claim 9, wherein the bearing includes, as the guide portion, a thick cylinder portion formed continuously with the cylinder portion and having a thick wall thicker than a wall of the cylinder portion, the thick cylinder portion having formed in the thick wall a plurality of through holes directed approximately perpendicularly to the shaft.

11. The pump of claim 9, wherein the pump includes an upper casing in which the suction inlet is formed, and a thrust washer supported by the upper casing so as to be non-rotatable relative to the shaft; and the bearing constitutes a thrust bearing by an upper end face of the cylinder portion, the thrust washer, and a support portion of the upper casing supporting the thrust washer.

12. A heat pump apparatus including the pump of claim 9.

13. A including a suction inlet for drawing in a liquid and a discharge outlet for discharging the liquid drawn in, wherein a suction direction and a discharge direction of the liquid are approximately perpendicular to each other, the pump comprising:

a shaft positioned downstream of the suction inlet such that a longitudinal direction of the shaft is approximately same as the suction direction;

an impeller configured in a disk shape that rotates around an axis of rotation located in the shaft, the impeller having a plurality of blades formed radially in a radial direction from a center area located at a center portion of the disk shape as seen in the suction direction, the plurality of blades being positioned at a longitudinal position approximately same as a longitudinal position of the discharge outlet when a longitudinal direction is defined in terms of the longitudinal direction of the shaft, and the impeller being configured to rotate around the axis of rotation located in the shaft, thereby causing the liquid to be drawn in from the suction inlet and discharged from the discharge outlet; and a bearing that receives the shaft, the bearing having a guide portion positioned at the center area of the impeller and configured to guide the liquid drawn in from the suction inlet to the discharge outlet, wherein the bearing includes, as the guide portion, a plurality of blades shaped in a shape corresponding to a shape of the blades of the impeller.

14. A heat pump apparatus including the pump of claim 13.

15. A pump including a suction inlet for drawing in a liquid and a discharge outlet for discharging the liquid drawn in, wherein a suction direction and a discharge direction of the liquid are approximately perpendicular to each other, the pump comprising:

a shaft positioned downstream of the suction inlet such that a longitudinal direction of the shaft is approximately same as the suction direction;

an impeller configured in a disk shape that rotates around an axis of rotation located in the shaft, the impeller having a plurality of blades formed radially in a radial direction from a center area located at a center portion of the disk shape as seen in the suction direction, the plurality of blades being positioned at a longitudinal position approximately same as a longitudinal position of the discharge outlet when a longitudinal direction is defined in terms of the longitudinal direction of the shaft, and the impeller being configured to rotate around the axis of rotation located in the shaft, thereby causing the liquid to be drawn in from the suction inlet and discharged from the discharge outlet; and a bearing that receives the shaft, the bearing having a guide portion positioned at the center area of the impeller and configured to guide the liquid drawn in from the suction inlet to the discharge outlet, wherein the bearing includes an upper bearing configured to receive one end portion of the shaft at a side facing the suction inlet and have the guide portion, and a lower bearing configured to receive an other end of the shaft at a side opposite from the suction inlet.

16. A heat pump apparatus including the pump of claim 15.

* * * * *

UNITED STATES PATENT AND TRADEMARK OFFICE

CERTIFICATE OF CORRECTION

PATENT NO. : 8,753,068 B2
APPLICATION NO. : 13/096419
DATED : June 17, 2014
INVENTOR(S) : Noriaki Matsunaga et al.

It is certified that error appears in the above-identified patent and that said Letters Patent is hereby corrected as shown below:

In the Claims

Col. 11, line 6, in claim 13, change "A including a suction inlet" to --A pump including a suction inlet--.

Signed and Sealed this
Sixteenth Day of September, 2014

Michelle K. Lee

Michelle K. Lee
*Deputy Director of the United States Patent and Trademark Office*